US006213600B1

(12) United States Patent
Kobayashi et al.

(10) Patent No.: US 6,213,600 B1
(45) Date of Patent: Apr. 10, 2001

(54) INK-JET RECORDING APPARATUS CAPABLE OF LIMITEDLY USING ONLY GENUINE INK CARTRIDGE, INK CARTRIDGE USABLE IN THE SAME, AND INK REFILLING MEMBER

(75) Inventors: Kenji Kobayashi; Kazutami Noguchi; Kenzo Ito, all of Tokyo; Masayuki Ikeda, Saitama; Kenji Igarashi, Tokyo, all of (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/496,701

(22) Filed: Feb. 2, 2000

(30) Foreign Application Priority Data

Feb. 4, 1999 (JP) ..... 11-027140

(51) Int. Cl.[7] ..... B41J 2/17
(52) U.S. Cl. ..... 347/86; 347/7
(58) Field of Search ..... 347/7, 85, 86, 347/87; 503/200; 62/3.3; 219/216, 229

(56) References Cited

U.S. PATENT DOCUMENTS

| | | | | |
|---|---|---|---|---|
| Re. 33,517 | * | 1/1991 | Shibata et al. | 503/200 |
| 4,933,536 | * | 6/1990 | Lindemann et al. | 235/375 |
| 5,502,967 | * | 4/1996 | Nakagawa et al. | 62/3.3 |
| 5,847,735 | * | 12/1998 | Betschon | 347/86 |

FOREIGN PATENT DOCUMENTS

| | | |
|---|---|---|
| 0 778 144 | 6/1997 | (EP) . |
| 0 782 053 | 7/1997 | (EP) . |
| 0 812 693 | 12/1997 | (EP) . |

OTHER PUBLICATIONS

Patent Abstracts of Japan, vol. 017, No. 673 (P–1658), Dec. 10, 1993 & JP 05 224479 A (Toshiba Corp), Sep. 3, 1993.
Patent Abstracts of Japan, vol. 1998, No. 04, Mar. 31, 1998 & JP 09 314828 A (Ricoh Co Ltd), Dec. 9, 1997.
Patent Abstracts of Japan, vol. 1996, No. 06, Jun. 28, 1996 & JP 08 039824 A (Canon Inc), Feb. 13, 1996.

* cited by examiner

*Primary Examiner*—N. Le
*Assistant Examiner*—Anh T. N. Vo
(74) *Attorney, Agent, or Firm*—Frishauf, Holtz, Goodman, Langer & Chick, P.C.

(57) ABSTRACT

Three ink storage chambers stored into a main body case of an ink cartridge is isolated from four surfaces of this main case body by way of a partition and depressing partition portions projected from this portion. Also, these ink storage chambers are isolated from a bottom portion of the main body case by a stepped portion of a lower cylindrical portion, and is arranged by forming space between a lid and the own ink chambers. Only refilling hole portions of an upper cylindrical portion are communicated with an external portion via holes of the lid. A label on which a trademark "ABC" is printed is attached onto the upper portions of the three refilling hole portions. A label reading apparatus is provided on the side of an ink-jet printer, and a printing operation by any ink cartridge other than the genuine-labeled in cartridge is not carried out. As a genuine ink refilling member, at least ink bottles and a label are employed as a set of such a genuine ink refilling member. The ink cannot be refilled via a hole formed in any portion of an ink cartridge, except for the refilling hole portion.

20 Claims, 13 Drawing Sheets

INK-JET RECORDING APPARATUS CAPABLE OF LIMITEDLY USING ONLY GENUINE INK CARTRIDGE, INK CARTRIDGE USABLE IN THE SAME, AND INK REFILLING MEMBER

BACKGROUND OF THE INVENTION

1. Field of the Invention

The present invention generally relates to an ink-jet recording apparatus for performing a printing operation by using liquid ink. More specifically, the present invention is directed to such an ink-jet recording apparatus capable of limitedly using only a genuine ink-jet cartridge (normally-manufactured ink-jet cartridge), and also capable of refilling ink into such a genuine ink-jet cartridge, while cost performance is improved with maintaining a high recording quality. Also, the present invention is directed to an ink cartridge employed in this ink-jet recording apparatus, and to an ink refilling member used to refill ink into such a genuine ink cartridge.

2. Description of the Related Art

Recently, ink-jet recording apparatuses such as ink-jet printers are generally used in connection with popularization of personal computers. As recording systems by printing heads of such ink-jet recording apparatuses, there are one recording system with employment of a piezoelectric element and another recording system with employment of a heating element. In any of these ink-jet recording systems, ink is supplied from an ink storage chamber of an ink cartridge to a printing head, and then droplets of ink are jetted from very fine ink jetting ports of this printing head so as to print out on a recording paper. Generally speaking, there are two different types of ink cartridges, namely an ink cartridge made with a printing head in an integral form, and an ink cartridge separately provided with a printing head.

FIG. 11 is a perspective view for schematically representing a major portion of the above-explained conventional ink-jet recording apparatus. The ink-jet recording apparatus 1 shown in FIG. 11 is, for instance, a thermal ink-jet type serial printer. In this ink-jet recording apparatus 1, a printing head 2 is supported by a carriage 3, and is positioned opposite to a platen roller 4. The carriage 3 is slidably supported by a guide shaft 5 and is engaged with a geared belt 6. The geared belt 6 is rotary-driven along both a normal direction and a reverse direction via a gear (not shown) by rotating a motor 7 along both the normal direction and the reverse direction. As a result, while the printing head 2 is slid along the platen roller 4 in a width direction (namely, main scanning direction) of this ink-jet recording apparatus 1, indicated by a double arrow "A" of the recording paper 8 (see FIG. 11), this printing head 2 prints out characters and images, for example, characters of "a", "b", "c", "d", "e" shown in this drawing.

The platen roller 4 sandwiches the paper 8 between an auxiliary roller 9 and this platen roller 4, and is driven by another motor 10 so as to intermittently convey this paper 8 along the longitudinal direction (namely, sub-scanning direction). As a result, the printing operation is carried out in accordance with the line sequential manner by the printing head 2. A head cleaning apparatus 11 is arranged at a right edge position (namely, upper right oblique direction as viewed in FIG. 11) of the platen roller 4. This head cleaning apparatus 11 is equipped with a cleaning port 12. When the printing head 2 is located at a home position, namely right edge position, this cleaning port 12 is located opposite to an ink jetting plane of the printing head 2. At this time, while the ink jetting plane of the printing head 2 is periodically engaged with the cleaning apparatus 11 by the cleaning port 12, or is engaged therewith, if necessary, this ink jetting plane is cleaned.

As a consequence, it is possible to prevent, or avoid stuffing of ink jetting nozzles of this printing head 2. It should be understood that the above-explained drive operations of the respective units are controlled by a control unit (not shown in detail).

Also, two sorts of ink cartridges, namely a black ink cartridge 13 and a color ink cartridge 14 are detachably mounted on the above-explained carriage 3. It should also be noted that the respective ink cartridges 13 and 14 are provided separately from the printing head 2 as shown in this drawing.

FIG. 12 is a perspective view for illustratively showing the above-described carriage 3, the black ink cartridge 13 and the color ink cartridge 14, which are mounted on this carriage 3. As indicated in this drawing, a concave portion 15 and another concave portion 16 are formed in case side portions of the respective ink cartridges 13 and 14. A lock member 17*a* and another lock member 17*b* are provided on the side of the carriage 3. Since these lock members 17*a* and 17*b* are engaged with the above-explained concave portions 15 and 16, the respective cartridges 13 and 14 are fixed/supported on the carriage 3. An annular engaging portion 18 is formed at a backward lower portion of this carriage 3. This annular engaging portion 18 is outwardly fitted on the guide shaft 5 (see FIG. 11) so as to be engaged with this guide shaft 5.

FIG. 13A is a perspective view used to explain a structure made when the above-explained color ink cartridge 14 is assembled. In this perspective view, a partial portion of this assembled structure is cut away. FIG. 13B is a side-sectional view of this assembled component.

As indicated in FIG. 13A and FIG. 13B, the color ink cartridge 14 is constructed in such a manner that an internal portion of a cartridge case 19 is partitioned by two isolating walls 21-1 and 21-2 into three ink chambers 20 (namely, 20-1, 20-2, 20-3). An ink holding member 22 made of sponge is contained in each of the ink chambers 20. The respective color ink of yellow (Y), magenta (M), and cyan (C) are fully filled into the respective ink chambers 20-1 to 20-3. These colors correspond to three primary colors employed in the subtractive mixture of color stimuli. Thereafter, a lid 23 is adhered onto the cartridge case 19 and then sealed by way of the ultrasonic melting method. Then, the resulting ink cartridge 14 is shipped from a factory.

A cylinder 24 (namely, 24-1, 24-2, 24-3) is provided on an ink supply port formed in the bottom portion of each of the above-explained three ink chambers 20. As to the cylinder 24, an upper surface 25 thereof is closed, and a slit (namely, 26-1, 26-2, 26-3) are formed on a peripheral surface of the cylinder portion located just under this upper surface 25, so that the color ink stored inside the ink chamber 20 may be soaked, or penetrated from this slit 26. In this case, when an ink cartridge is constituted without such an upper surface 25 of the cylinder 24, the ink directly drops along the lower direction, so that a large amount of color ink may be easily supplied. As a consequence, the color ink cartridge 14 is arranged in such a manner that the above-explained upper surface 25 and the slit 26 are provided so as to supply a proper amount of color ink.

A seal 27 (namely, 27-1, 27-2, 27-3) made of, for example, an aluminum foil is adhered onto the lower end of the cylinder 24. As indicated in FIG. 12, when this color ink cartridge 14 is mounted on the carriage 3, a coupling projection (not shown in detail) breaks this seal 27, so that an ink path is coupling-formed. This coupling projection is communicated with the printing head 2 arranged on the carriage 3, and is provided so as to receive the color ink. As a result, the color ink stored in the respective ink chambers 20 can be supplied to the printing head 2.

To refill improper ink (not-genuine ink) into the color ink cartridge 14 (will be discussed later), a hole may be formed in either the upper surface of the cartridge case 19 or the side surface thereof by using a drill. However, for example, when such a hole is formed in a certain portion of the upper surface 25 of the cylinder 24 to refill the not-genuine ink, as previously explained, this not-genuine ink will drop downwardly. Under such a circumstance, it is practically difficult to form such an improper hole in the cartridge case 19.

On the other hand, in such a case that an ink storage amount of the ink chamber 20 is reduced to reach a preselected amount by jetting the ink, printed characters/images are blurred. Accordingly, the user may suppose that the ink-jet recording apparatus is brought into the malfunction, or the ink stored in the ink cartridge is depleted. When the ink is depleted, the presently mounted ink cartridge is replaced by a new ink cartridge. It is preferable that the depletion of ink should be notified at least before the printed characters/images are blurred.

To this end, generally speaking, the requirements of replacing the respective ink cartridges 13 and 14 in response to such a fact that the ink storage amount of the ink chamber 20 is reduced to a preselected ink amount by jetting the ink may be visually displayed on a display unit (not shown), or may be acoustically notified by producing alarm sounds from a buzzer. Various sorts of notifying constructions may be proposed so as to notify such an ink depletion. Since the below-mentioned notification construction may be relatively simply arranged, this construction is usually employed, which is reflected on the ink-jet recording apparatus 1 shown in FIG. 11. That is, the printing rate after the new ink cartridge has been set is converted into the ink jetting amount, and while the accumulated amount thereof is compared with the ink storage amount of the ink cartridge, when the ink-remaining amount is reached to a preselected ink amount by checking the comparison result, this ink depletion is notified.

The respective black and color ink cartridges 13 and 14 may be constituted by employing the printing head 2 in the integral form, or separate form. In any constructions, since the printed characters/images are blurred when a sufficiently large amount of the black, or color ink is not supplied, these black and color ink cartridges 13 and 14 may be formed in such a manner that a depleted ink cartridge may be readily replaced by a new ink cartridge by a user in response to the above-explained notification. Then, when new ink cartridges are mounted on the ink-jet recording apparatus, the printing operation may be continuously carried out.

On the other hand, conventionally, these black and color ink cartridges 13 and 14 are provided from the manufacturer of this conventional ink-jet recording apparatus 1 as expendable supplies adapted to this ink-jet recording apparatus 1. The ink-depleted ink cartridge which has been replaced by the new ink cartridge is disposable. That is, this ink cartridge is not designed to be refilled by new ink. As a consequence, such a disposable ink cartridge may cause various problems, for instance, garbage problems, low cost performance aspects, and not-user friendly product. More specifically, when an expensive printing head integral-type cartridge is employed, this user-friendly product matter cannot be realized.

On the other hand, not-genuine cartridges manufactured by third parties from low cost materials, and furthermore, specially-designed piercing tools capable of only refilling ink into genuine ink cartridges and/or not-genuine refilling ink, which are also manufactured by third parties, are commercially available in the market.

However, such not-genuine ink cartridges may cause serious problems, although the shapes of these not-genuine ink cartridges may be made coincident with those of the genuine ink cartridges. That is, since the ink itself stored in these not-genuine ink cartridges is essentially different from the genuine ink, this not-genuine ink may be stuffed, or may not print out in desirable colors similar to the refilling not-genuine ink. This is because the manufacturing method of such not-genuine ink is completely different from that of the genuine ink. Moreover, since such not-genuine products having poor qualities are used, the conventional ink-jet recording apparatus itself would be brought into malfunction states.

SUMMARY OF THE INVENTION

The present invention has been made to solve these problems, and therefore, has an object to provide such an ink-jet recording apparatus capable of limitedly using only a genuine ink cartridge which can be adapted to this ink-jet recording apparatus. Also, another object of the present invention is to provide an ink cartridge into which only genuine ink can be refilled, and furthermore, to provide an ink refilling member by which only genuine ink can be refilled into such a genuine ink cartridge. A further object of the present invention is to provide a printer system capable of maintaining a high printing quality of the above-described ink-jet recording apparatus, and also capable of realizing low-cost printing operation.

To achieve the above-described objects, an ink-jet recording apparatus, according to an aspect of the present invention, is featured by that in an ink-jet recording apparatus in which an ink cartridge is equipped with a printing unit for mounting thereon a printing head; an ink storage chamber for storing thereinto ink; an ink refilling hole portion communicated with the ink storage chamber and capable of refilling the ink into the ink storage chamber; and a label on which predetermined information is described, attached so as to seal the ink refilling hole portion; the ink cartridge is detachably mounted on the printing unit; and the ink supplied from the ink cartridge is jetted from the printing head so as to print out on paper, the ink-jet recording apparatus is comprised of: detecting means for reading out the predetermined information described on the label; judging means for judging as to whether or not the information read by the detecting means is such information adapted to the own ink-jet recording apparatus; and print control means for determining whether or not the printing operation is carried out by employing the ink cartridge mounted thereon based upon the judgment result obtained from the judging means.

Also, the ink-jet recording apparatus with employment of the above-explained arrangements is featured by further comprising: ink information notifying means for notifying one of a need to replace the ink cartridge by a new ink cartridge, and a need to refill ink in response to such a fact that an amount of ink stored in the ink storage chamber is reduced to a preselected ink amount, since the ink cartridge equipped with the label for describing the adaptable information is used to jet the ink; and writing means for rewriting the adaptable information of the label attached on the ink cartridge into non-adaptable information for the own ink-jet recording apparatus in conjunction with the notification issued from the ink information notifying means.

Also, the ink-jet recording apparatus with employment of the above-explained arrangements is featured by that the label is constructed of a thermosensitive label, and the writing means is constituted by a heat radiating member, and alternatively, the writing means may be arranged by a stamp mechanism.

Further, in order to achieve the above-described objects, an ink cartridge, according to another aspect of the present invention, is featured by such an ink cartridge detachably mounted on a printing unit of an ink-jet recording apparatus, comprising: an ink storage chamber for storing thereinto ink; an ink refilling hole portion communicated with the ink storage chamber and capable of refilling the ink into the ink storage chamber; and a label attached onto the ink cartridge so as to seal the ink refilling hole portion, on which predetermined information is described, the predetermined information being read by detecting means provided in the ink-jet recording apparatus when the ink cartridge with the label is mounted on the ink-jet recording apparatus, whereby ink is jetted from a printing head mounted on the printing unit to print out on paper.

Also, the ink cartridge with employment of the above-explained structures is featured by that the ink cartridge is provided with a predetermined space defined between an outer wall of the ink cartridge and the ink storage chamber; and the predetermined space is capable of prohibiting that the ink is refilled into the ink storage chamber without using the ink refilling hole portion.

Also, the ink cartridge with employment of the above-explained structures is featured by a repapering label in which the information to be read is described on one surface of the repapering label; adhesive agent is provided on the other surface thereof; and the repapering label is formed via the adhesive agent with exfoliation paper in an integral form; whereby the repapering label is separated from the exfoliation paper and then is capable of sealing the ink refilling hole portion.

Also, the ink cartridge with employment of the above-explained structures is featured by that the label is constructed of a thermosensitive label.

Also, the ink cartridge with employment of the above-explained structures is featured by that the information to be read is such information for indicating that the ink cartridge with the label is adapted to the ink-jet recording apparatus.

Also, the ink cartridge with employment of the above-explained structures is featured by that the information to be read is especially a description of a trademark, and alternatively, the information to be read may be a bar code.

Moreover, to achieve the above-explained objects, an ink refilling member, according to a further aspect of the present invention, is featured by such an ink refilling member for refilling ink into an ink cartridge having an ink refilling hole portion which is communicated with an ink storage chamber and is capable of refilling the ink, the ink cartridge being detachably mounted on a printing unit of an ink-jet recording apparatus wherein the ink is jetted from a printing head mounted on the printing unit to thereby print out on paper, comprising: an ink refilling vessel for storing thereinto ink which is refilled via the ink refilling hole portion into the ink storage chamber of the ink cartridge; and a repapering label in which predetermined information is described on one surface of the repapering label; adhesive agent is provided on the other surface thereof; the repapering label is formed via the adhesive agent with exfoliation paper in an integral form; and the predetermined information is to be read by detecting means provided in the ink-jet recording apparatus when the ink cartridge with the label is mounted on the ink-jet recording apparatus, whereby the repapering label is separated from the exfoliation paper and then is capable of sealing the ink refilling hole portion.

Also, the ink refilling member with employment of the above-described structures is featured by that the repapering label is a thermosensitive label.

Also, the ink refilling member with employment of the above-described structures is featured by that the information to be read is such information for indicating that the ink cartridge with the label is adapted to the ink-jet recording apparatus.

Also, the ink refilling member with employment of the above-described structures is featured by that the information to be read is especially a description of a trademark, and alternatively, the information to be read may be a bar code.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERRED EMBODIMENTS

Referring now to drawings, various preferred embodiments of the present invention will be described in detail.

STRUCTURES OF FIRST INK-JET PRINTER AND INK CARTRIDGE

Figure 1A:
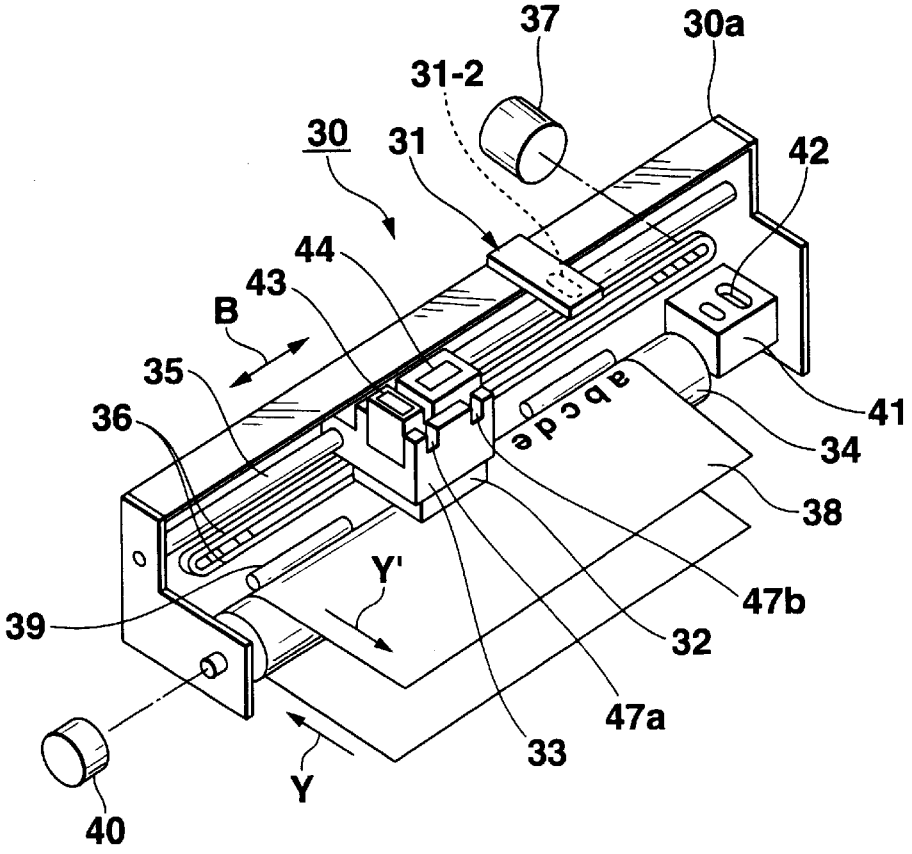
FIG. 1A is a perspective view for representing a major portion of an ink-jet printer corresponding to an ink-jet recording apparatus according to an embodiment of the present invention, and an ink cartridge mounted on a carriage of this ink-jet printer.
Figure 1B:
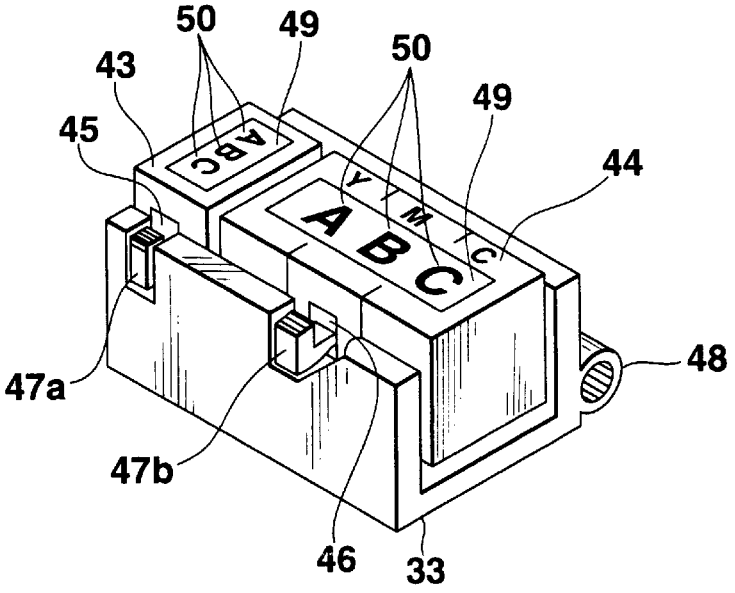
FIG. 1B is an enlarged perspective view for showing the carriage and the cartridge portion indicated in FIG. 1A.

FIG. 1A is a perspective view for representing a major portion of an ink-jet printer corresponding to an ink-jet recording apparatus, according to a first embodiment of the present invention, and an ink cartridge mounted on a carriage of this ink-jet printer. FIG. 1B is an enlarged perspective view for showing the carriage and the cartridge portion indicated in FIG. 1A.

Figure 11:
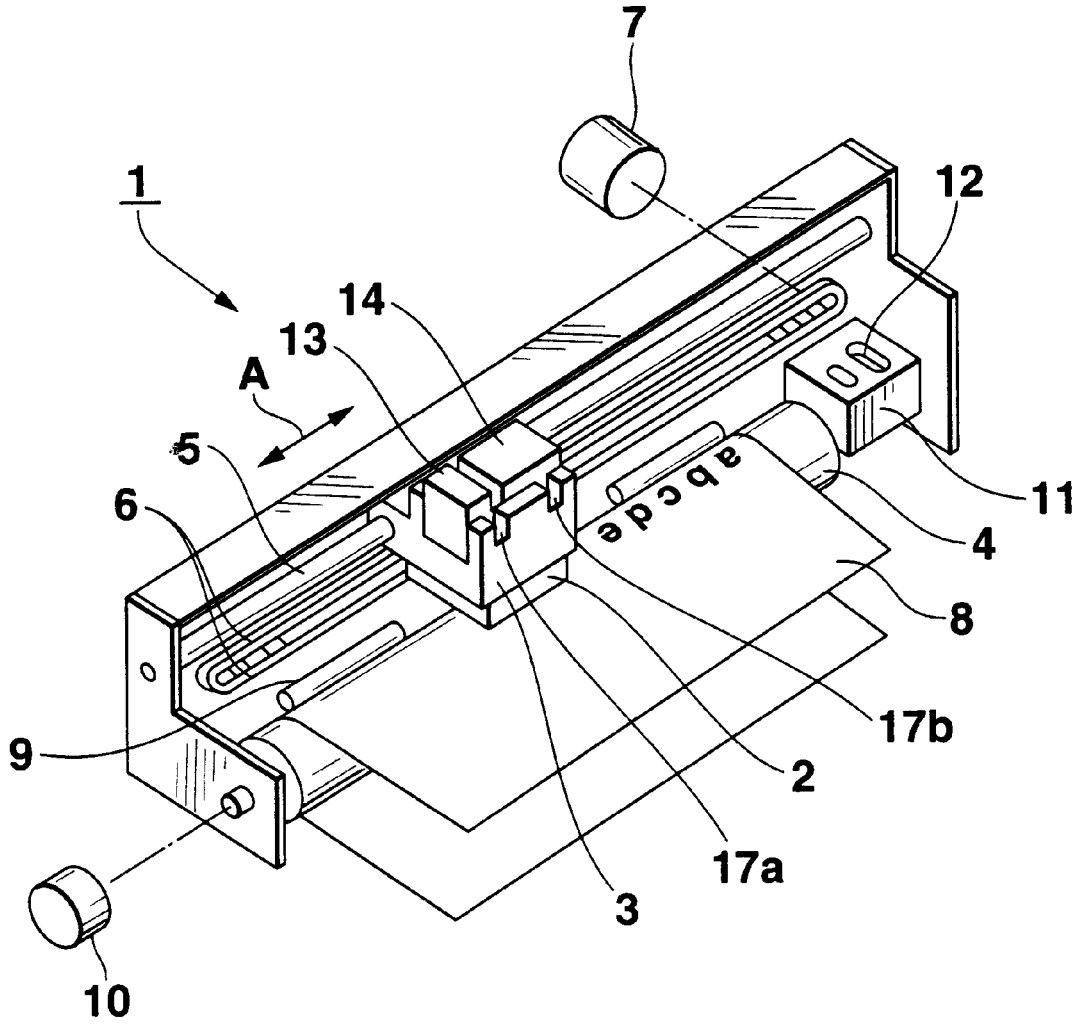
FIG.11 (PRIOR ART)
FIG. 11 is a perspective view for schematically showing the major portion of the conventional ink-jet recording apparatus.

It should be understood that structural components of the ink-jet printer 30 according to this first embodiment, shown in FIG. 1A, are identical to these of the conventional ink-jet recording apparatus shown in FIG. 11. That is, this first ink-jet printer 30 is provided with a printing head 32, a carriage 33, a platen roller 34, a guide shaft 35, a geared belt 36, a motor 37, paper 38, an auxiliary roller 39, a motor 40, a head cleaning apparatus 41, a cleaning port 42, and lock members 47*a*/47*b* of the carriage 33, and also an annular engaging portion 48 of the carriage 33. These structural components are the same as the printing head 2, the carriage 3, the platen roller 4, the guide shaft 5, the geared belt 6, the motor 7, the paper 8, the auxiliary roller 9, the motor 10, the head cleaning apparatus 11, the cleaning portion 12, and the lock members 17*a*/17*b* of the carriage 3, and also the annular engaging portion 18 of the carriage 3, respectively employed in the conventional ink-jet recording apparatus.

Accordingly, only different arrangements of the first ink-jet printer 30 from those of the conventional ink-jet recording apparatus 1 will now be explained. That is, a detecting apparatus 31 is arranged within a travel path along which the carriage 33 of an apparatus main body 30*a* is traveled. This detecting apparatus 31 is equipped with a sensor 31-2 constructed of a CCD (charge-coupled device) at a tip portion thereof, and may function as a detecting means for reading out information described on a label (will be explained later). Also, the first ink-jet printer 30 is provided with a print control arrangement formed based upon this detecting apparatus 31. This print control is carried out by way of a control apparatus 51 (see FIG. 2). This control apparatus 51 is mounted on a circuit board employed in an electronic equipment (not shown in detail, will be described later).

Figure 12:
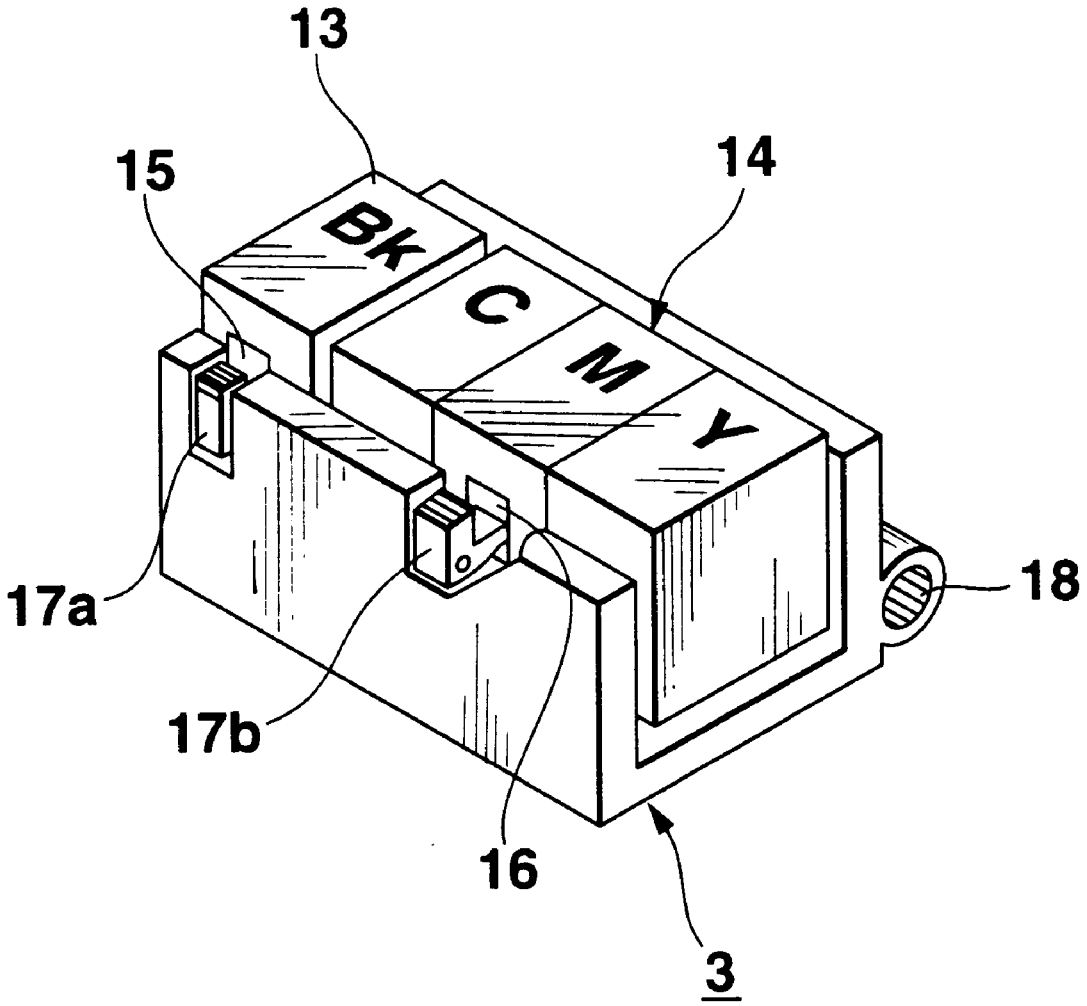
FIG.12 (PRIOR ART)
FIG. 12 is a perspective view for showing both the cartridge of the conventional ink-jet recording apparatus, and the black ink cartridge/color ink cartridge mounted on this conventional carriage.

Similarly, outer shapes (see FIG. 1B) of a black ink cartridge 43 and a color ink cartridge 44 are made similar to those of the conventional black ink cartridge 13 and color ink cartridge 14 indicated in FIG. 12, as to such a point that concave portions 45 and 46 are provided and are engaged with the lock members 47*a* and 47*b* of the carriage 33. However, to the black/color ink cartridges 43 and 44 are featured by that labels 49 are attached onto upper surfaces of these ink cartridges as represented in FIG. 1B.

That is, this featured labels 49 indicate specific information related to the first ink-jet printer 30. As an example of the labels 49 shown in FIG. 1B, a description 50 of characters "ABC" is observed. Various sorts of descriptions may be employed as this description 50, for instance, a character and an illustration. Preferably, a trademark corresponding to maker logogram information of this ink-jet printer 30 is employed as this description 50. A character "YMC" indicative of ink colors is seal-impressed, or printed on a case upper surface portion at an outer position of this label 49 of the color ink cartridge 44.

These ink cartridges (namely, black ink cartridge 43 and color ink cartridge 44) are genuine ink cartridges which are supplied from, for example, a genuine printer manufacturer.

When the carriage 33 is moved, or traveled during the initial operation of the ink-jet printer 30 under such a condition these black/color ink cartridges are mounted on the carriage 33, the information of this description 50 of the label 49 may be read by the sensor 31-2 of the above-described detecting apparatus 31.

Now, when the information of description 50 of this label 49 cannot be read out under normal condition, the control apparatus provided on the side of the main body 30*a* of the ink-jet printer 30 may judge that the genuine ink cartridge is not mounted, so that this ink-jet printer 30 does not execute the printing operation.

The reading/judging operations of the description 50 of the label 49 may be realized by employing the following character recognizing method. That is, while a character recognition sensor is employed as the sensor 31-2, character patterns of maker logograms are previously stored in an EEPROM employed in the control apparatus 51 (see FIG. 2), and then the character pattern of the description 50 read from the label 49 is compared with the stored character pattern for pattern matching operation.

CONTROL SYSTEM OF FIRST INK-JET PRINTER

Figure 2:
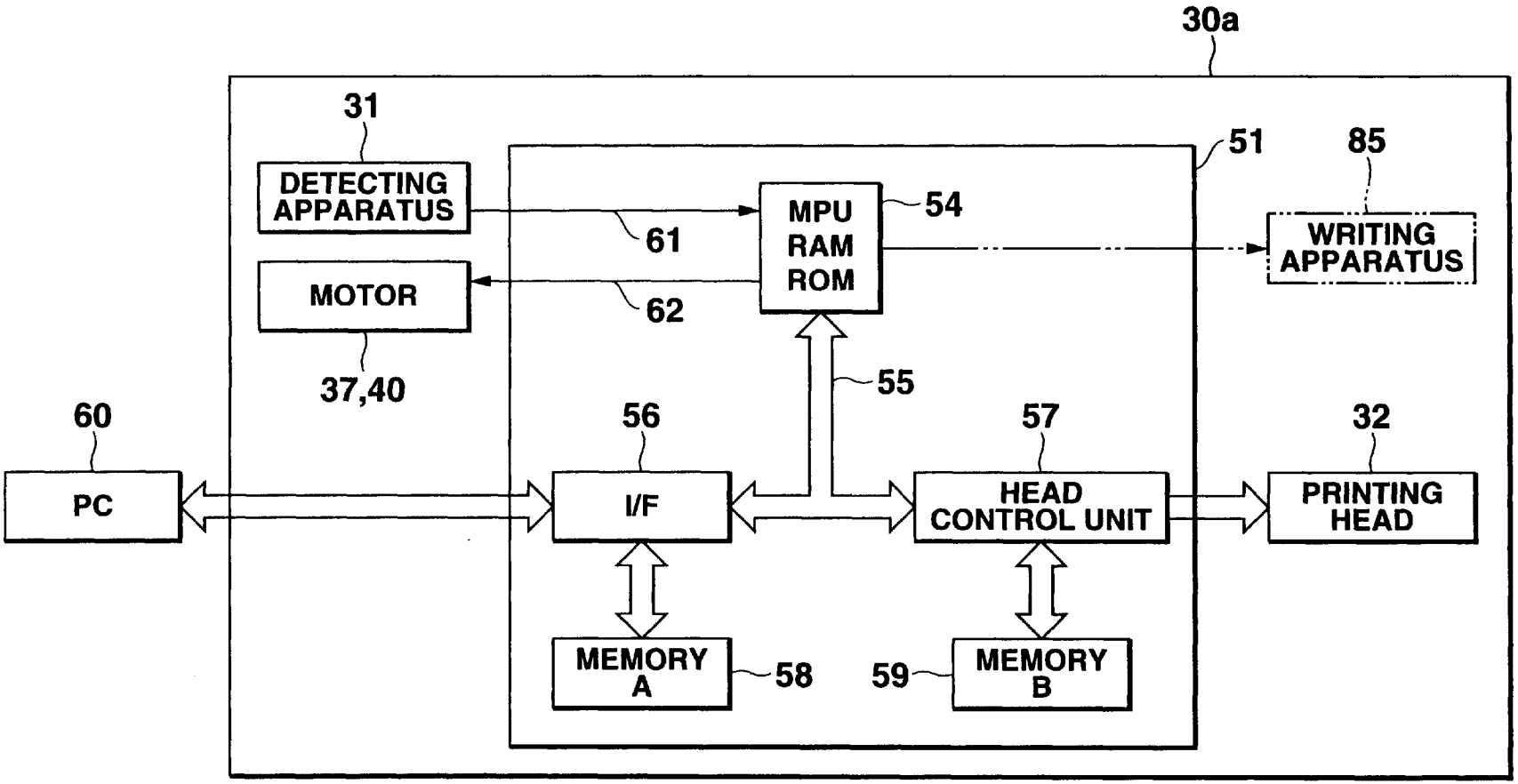
FIG. 2 is a block diagram for indicating a system arrangement of a control apparatus employed in the ink-jet printer according to the embodiment of the present invention.

FIG. 2 is a schematic block diagram for showing a system arrangement of a control apparatus 51 used in the ink-jet recording apparatus according to this first embodiment. The control apparatus 51 shown in this drawing is arranged by a plurality of electronic components mounted on a circuit board of an electronic apparatus unit (not shown) provided in the apparatus main body 30*a*. That is, this control apparatus 51 is arranged by an MPU (microprocessor unit) 54 equipped with a ROM (read-only memory) and a RAM (random access memory); an I/F (interface) 56 connected via a bus 55 to this MPU 54; a head control unit 57; a memory-A 58 connected to the I/F 56; and another memory-B 59 connected to the head control unit 57. The head control unit 57 drives/controls heating operation of a heating element employed in the printing head 32. This printing head 32 is supported by the carriage 33 which is reciprocated along the main scanning direction indicated by an arrow "B" of FIG. 1A.

Both print data and control data are entered via the I/F 56 from a PC (personal computer) 60 corresponding to the host appliance to this control apparatus 51. While the MPU 54 controls the memory-A 58 via the I/F 56, this MPU 54 receives the above-explained print data and control data. The MPU 54 expands the print data containing complementary data every 1 line via the head control unit 57 to the memory-B 59, and controls the printing head 32 via the head control unit 57 based upon this expanded print data. It should be noted that the print data and the control signals are transferred from the head control unit 57 via a flexible communication cable and the like to the print head 32, although not shown in this drawing.

Also, the detection output derived from the detecting apparatus 31, and a sensor output 61 derived from various sensors (not shown in detail) for monitoring the various portions of the ink-jet printer are entered into this MPU 54. On the other hand, the MPU 54 outputs a drive control signal 62. In response to this drive control signal 62, the motor 40 for transporting the paper 38 is controlled, and also the motor 37 for reciprocating the print head 32, namely the carriage 33 is controlled.

The MPU 54 controls the driving operations of these units while checking the sensor output 61 of the sensor. Otherwise, this MPU 54 judges as to whether or not the drive control is performed with reference to the detection result of the description 50 written on the label.

REPLACEMENT OF INK CARTRIDGE

When the printing operation of this first ink-jet printer 30 is continued, the amount of the ink stored in the presently-mounted ink cartridge is reduced, so that this presently-mounted ink cartridge should be replaced by a new ink cartridge. As a consequence, the MPU 54 monitors this replacement timing in accordance with the below-mentioned manner to notify the replacement requirement of this depleted ink cartridge.

As previously explained in the conventional ink-jet printer, also in the ink-jet printer 30 of the present invention, the printing rate defined after the new ink cartridge has been mounted is converted into the ink jetting amount. While the accumulated jetting amount is compared with the ink storage amount of the ink cartridge, when the ink remaining amount is reached to a predetermined ink amount, the requirement of this cartridge replacement is notified. Precisely speaking, in this first embodiment, a count value of a counter (not shown) employed in the MPU 54 is reset in response to the detection output 61 derived from the detecting apparatus 31 in such a case that a new/genuine ink cartridge is newly mounted on the carriage 33 and thus, the printing operation by this new/genuine ink cartridge is available. Thereafter, the ink jetting amount converted every time the printing operation is carried out is sequentially accumulated by the counter. Then, when the count value (accumulated amount) of this counter becomes equal to a preselected value, this message is notified on the display unit (not shown) of the apparatus main body 30*a*. As a result, in this first embodiment, the detecting apparatus 31 and the MPU 54 will constitute an ink information notifying means. Alternatively, in order to notify such ink information, for instance, an amount of ink stored in an ink cartridge may be directly and externally detected by employing a photosensor and the like, and then, this sensor signal may be outputted in a similar manner to the above-described output 61. This ink cartridge is made of an ink cartridge case, at least a portion of which is made transparent. Apparently, in this alternative case, the above-described photosensor will constitute the ink information notifying means.

OTHER GENUINE CARTRIDGE JUDGING METHODS

On the other hand, as to reading/judging of the information contained in the description 50 of the above-described label 49, the character recognition sensor has been employed as the sensor 31-2 so as to introduce the pattern matching method. Alternatively, the below-mentioned other methods may be employed as the simple judging apparatus.

It should be noted that this judging apparatus may also be used when the trademark written on the description 50 is not only such a character information, but also image information. In other words, this judging method is to sense, for example, the entire reflection light amount of the description 50. Furthermore, two different sensing methods may be employed. As one sensing method, a reflection light amount of a black-printed pattern of the description 50 is directly sensed. As the other sensing method, a grey-printed pattern is formed on the description 50, and while a filter having the same grey is prepared on the side of the sensor 31-2, this filter pattern is overlapped on the grey pattern of the description 50 of the label 49 and then a reflection light amount thereof is sensed. In any of these sensing methods, the judging apparatus may judge as to whether or not the sensed label corresponds to the genuine label by checking that the reflection light amount is present within a preselected range, or exceeds this preselected range, or is smaller than this preselected range. Based upon this judgement result, if the sensed label is not equal to the genuine label, then the MPU 54 controls in such a manner that the printing operation by the checked ink cartridge is not carried out.

In such an ink-jet printer 30, when the power supply is turned ON, the control apparatus 51 is initiated, so that the motor 37 is rotated along the normal/reverse directions to thereby drive the carriage 3 via the geared belt 36 in the initial drive mode. Thereafter, the carriage 3 is located to the home position. While this initial operation is carried out, both the above-described detecting apparatus 31 and control apparatus 51 read the information of the description 50 on the labels 49, and then judge as to whether or not the black/color ink cartridges 43 and 44 mounted on the carriage 3 are the genuine ink cartridges based on the read information. When the control apparatus 51 judges that the checked ink cartridges 43 and 44 are the genuine ink cartridges, the ink-jet printer 30 waits inputs of print data. Then, when a total number of paper to be printed and other instructions are entered into this control apparatus 51 by manipulating an entry key of an operation panel (not shown) by a user, or via a communication cable from a host appliance such as a personal computer 60, the control apparatus 51 drives the motor 40 so as to rotate the platen roller 34 and the auxiliary roller 39 in accordance with the print timing. As a result, the paper 38 supplied from the paper supply unit is intermittently conveyed along a direction "Y" and another direction "Y'" (namely, sub-scanning direction) shown in FIG. 1A. While the carriage 3 is slid on the guide shaft 5 in conjunction with the paper convey operation, the printing head 32 is driven to jet the ink onto this conveyed paper 38 in response to the print data. As a result, the printing operation is sequentially carried out line by line, so that the printed paper is successively ejected to a paper ejection unit (not shown either).

DETAILED STRUCTURE OF INK CARTRIDGE

Next, a description will now be made of the ink cartridge according to the present invention. It should also be noted that the three-color ink cartridge 44 will be explained in the following entire explanation in principle. A similar explanation may be applied to the monochromatic ink cartridge 43. Also, this 3-color ink cartridge 44 will be simply referred to as an "ink cartridge 44" hereinafter.

Figure 3A:
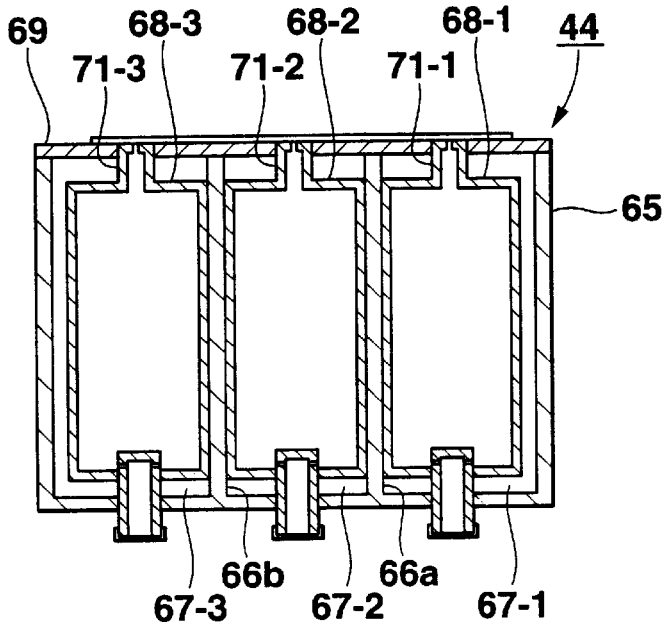
FIG. 3A is a sectional view for indicating a side surface of the ink cartridge according to the embodiment of the present invention.
Figure 3B:
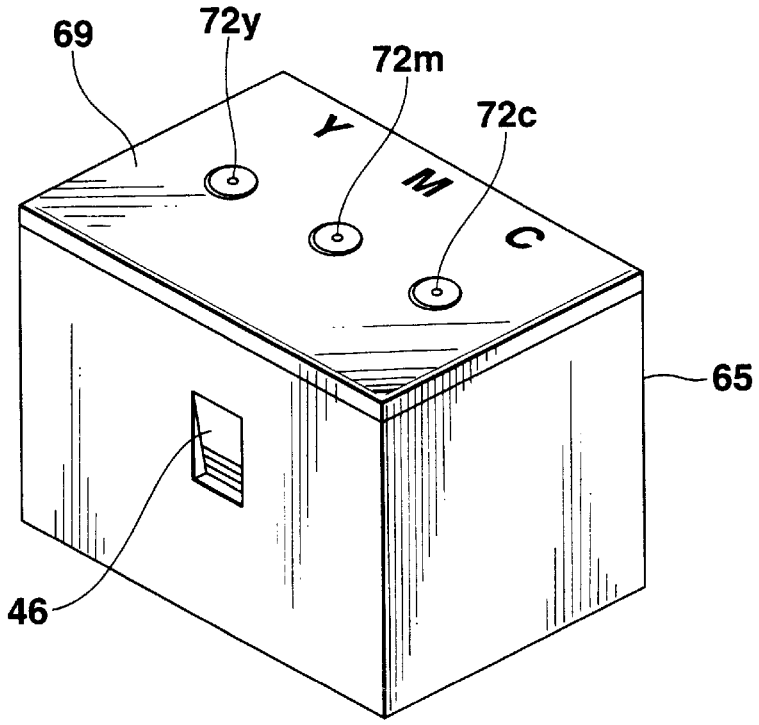
FIG. 3B is a perspective view for representing an outer appearance of a case of the ink cartridge shown in FIG. 3A, from which a label has been removed.

FIG. 3A is a sectional view for indicating a side surface of the ink cartridge 44 according to the embodiment of the present invention. FIG. 3B is a perspective view for representing an outer appearance of a case of the ink cartridge 44 shown in FIG. 3A, from which the label 49 has been removed.

As illustrated in FIG. 3A, the ink cartridge 44 is constructed as follows. That is, three empty chambers 67 (namely, 67-1, 67-2, 67-3) are formed by a partition 66 (namely, 66*a*, 66*b*) inside a main body case 65. An ink storage chamber 68 (namely, 68-1, 68-2, 68-3) is stored in each of these empty chambers 67-1, 67-2, 67-3. A lid 69 is used to cover the upper portions of the empty chambers, and the above-explained label 49 is adhered onto this lid 69.

Under this label 49, a refilling hole portion 72 (namely, 72*y*, 72*m*, 72*c*) shown in FIG. 3B are formed in an upper surface of an upper cylindrical portion 71 (namely, 71-1, 71-2, 71-3). These upper cylindrical portions 71-1, 71-2, and 71-3 are provided on the upper portions of the ink storage chambers 68-1, 68-2, and 68-3, as shown in the drawing. The refilling hole portions 72*y*, 72*m*, and 72*c* are arranged from the respective holes of the lid 69 corresponding thereto to the external portion. These refilling hole portions 72*y*, 72*m*, and 72*c* are previously formed, through which the ink can be refilled when the ink stored in the ink cartridge 44 is depleted. As a result, if the user purchases a genuine ink refilling member (will be discussed later), then this user can readily refill the ink via the refilling hole portions 72*y*, 72*m*, 73*c* into the ink storage chambers 68-1, 68-2, 68-3 by using this genuine ink refilling member.

It should also be noted that as previously expressed as "hole portion", when the ink cartridge 44 is a newly-purchased ink cartridge, this "hole portion" is not previously formed therein. In other words, when the ink of this newly-purchased ink cartridge is depleted in first time and therefore the ink is refilled thereinto, "holes" may be opened in these refilling hole portions 72*y*, 72*m*, and 72*c* by using a drill by the user.

In any cases, the label 49 shown in FIG. 1B, or FIG. 3A is adhered so as to seal the above-explained refilling hole portions 72*y*, 72*m*, and 72*c*. Then. the new ink cartridge with this label 49 is shipped from the factory to be saved to the user.

Figure 4:
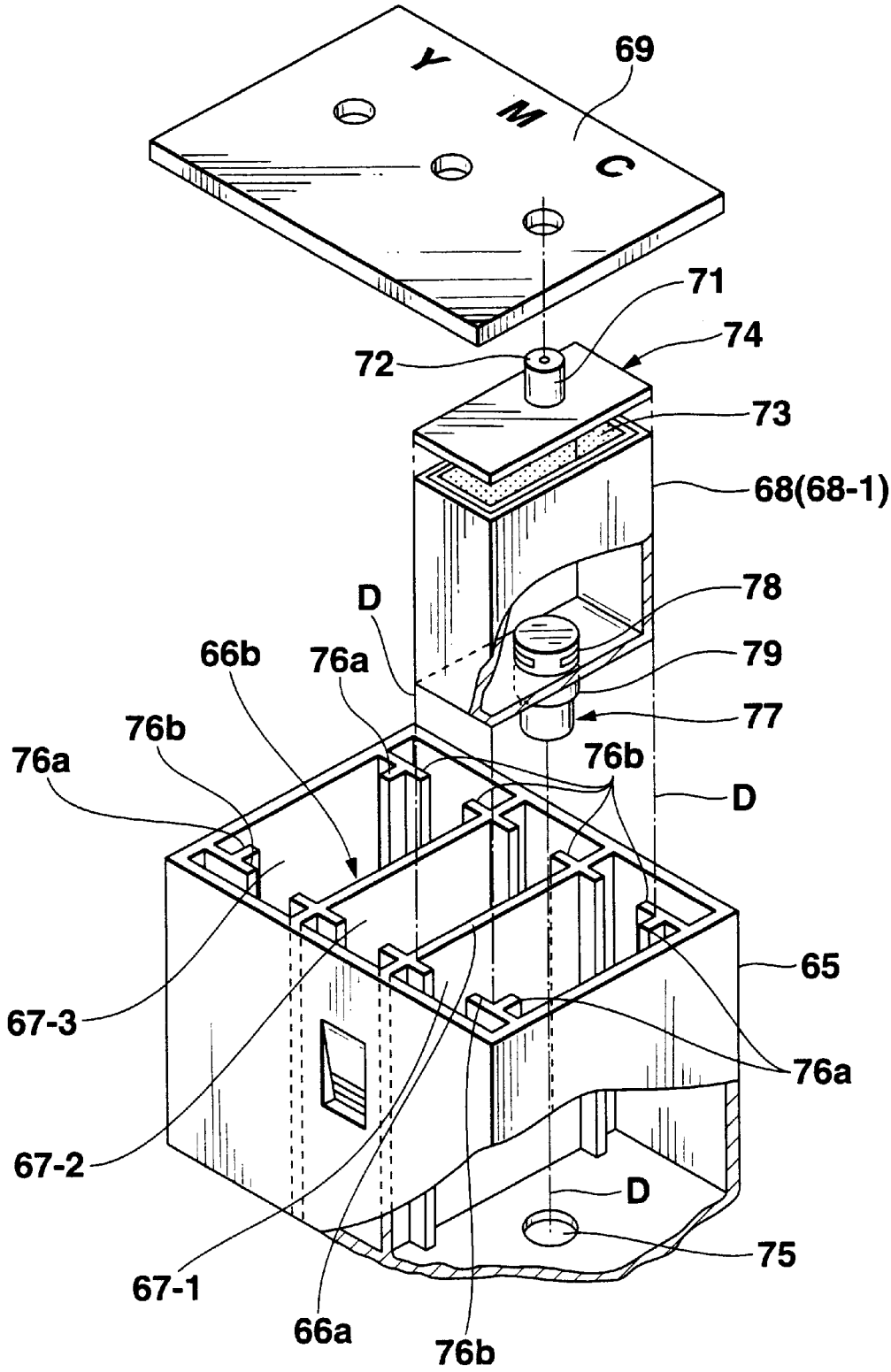
FIG. 4 is a perspective view for indicating such a condition that the ink cartridge according to the embodiment of the present invention is assembled in a factory.
Figure 5A:
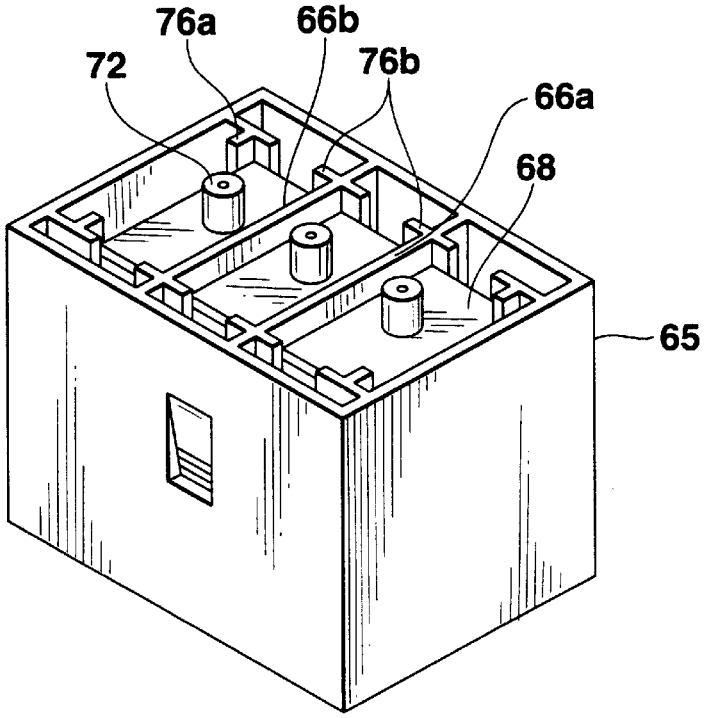
FIG. 5A and FIG. 5B are perspective views for showing a final stage of assembling the ink cartridge shown in FIG. 4.
Figure 5B:
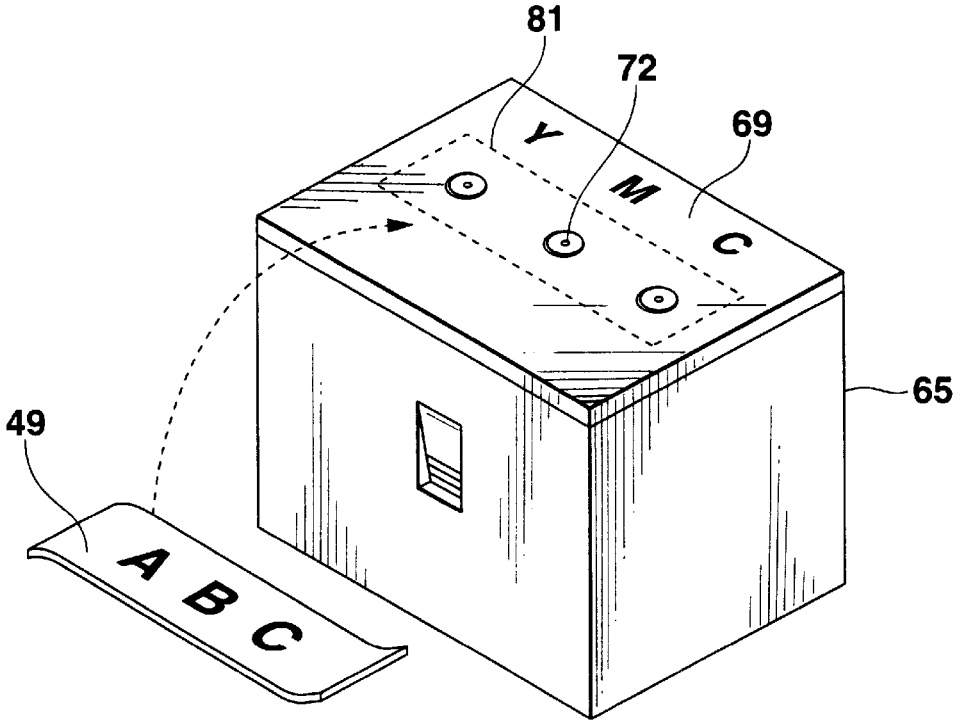

FIG. 4 is a perspective view for indicating such a condition that the ink cartridge 44 according to the embodiment of the present invention is assembled in a factory. FIG. 5A and FIG. 5B are perspective views for showing a final stage of assembling the ink cartridge 44 shown in FIG. 4. First as shown in FIG. 4, the respective units of the ink cartridge 44 is constituted by the above-explained main body case 65, ink storage chamber 68, and lid 69 of the entire case. Inside the ink storage chamber 68, for example, an ink holding member 73 made of a sponge member is stored. Another lid 74 is adhered onto the upper portion of this ink storage chamber 68.

In the above-explained main body case 65, as previously explained, three sets of the empty chambers 67 are formed by the partitions 66, and the entire upper surface of this main body case 65 is opened. Also, an engage hole 75 is formed in the lower portion of each of these empty chambers 67. Then, depressing partition portions 76*a* and 76*b* are further formed on the partition 66. As a result, as indicated by a dot and dash line "D" of FIG. 4, the ink storage chamber 68 is stored into the above-explained empty chamber 67. As indicated in the previous FIG. 3, or in FIG. 5 (will be discussed later), when the ink storage chamber 68 is engaged within the empty chamber 67, the four peripheral surfaces of the ink storage chamber 68 are fixed by the depressing partition portions 76*a* and 76*b*, and are held in such a way that the four peripheral surfaces of the ink storage chamber 68 are not close-fitted to the outer wall of the main body case 65.

Figure 13A:
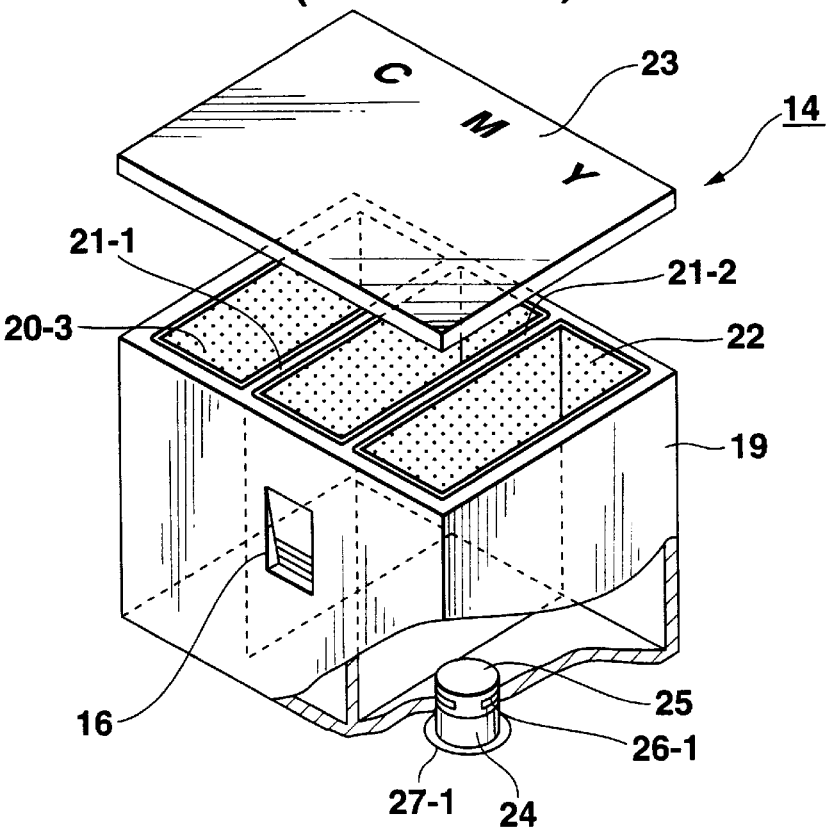
FIG.13A (PRIOR ART)
FIG. 13A is a perspective view for explaining the structure made when the conventional color ink cartridge is assembled.
Figure 13B:
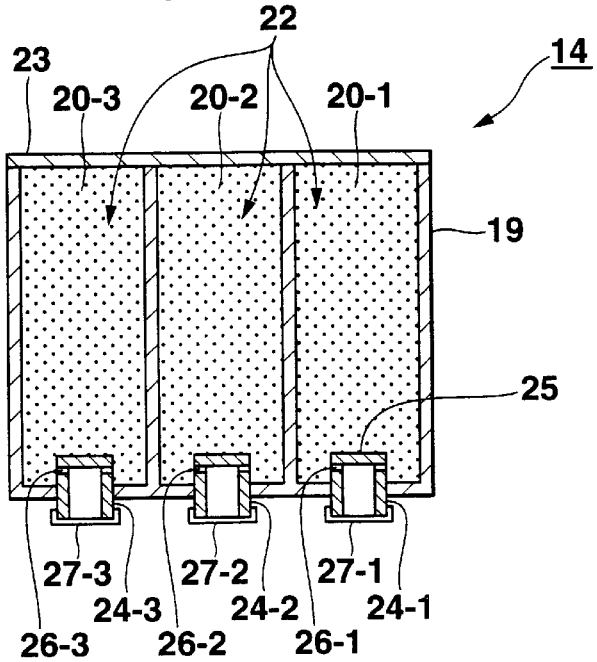
FIG.13B (PRIOR ART)
FIG. 13B is a sectional view for showing the side surface of the final assembling stage for the color ink cartridge of FIG. 13A.

Also, as indicated in FIG. 4, a lower cylindrical portion 77 is formed on the lower portion of the ink storage chamber 68 in an integral form. Similar to FIG. 13A and FIG. 13B, an upper surface of an upper portion of this lower cylindrical portion 77 is closed. This upper portion projects into the inside of the ink storage chamber 68. A slit 78 is formed in a peripheral surface of a tube portion located just under this upper surface. The ink stored in this ink storage chamber 68 may be penetrated via this slit 78 to the downward direction. Different from FIG. 13A and FIG. 13B, as to the lower portion which is externally project from the lower portion of the ink storage chamber 68, a stepped portion 79 is formed on a peripheral surface of the ink storage chamber 68 at a position separated from the outer surface of this ink storage chamber 68 by a predetermined length. This stepped portion 79 is formed in such a manner that a diameter of the upper portion thereof is made larger than a diameter of the lower portion thereof.

As a consequence, when the ink storage chamber 68 is stored/arranged in the empty chamber 67, this stepped portion 79 abuts against the edge portion of the engage hole 75 formed in the main body case 65. Thus, the bottom surface of the ink storage chamber 68 is separated from the bottom portion of the main body case 65 by such a length equal to the upper portion of the lower cylindrical portion 77 having the larger diameter. In other words, this ink storage chamber 68 is arranged in such a manner that this ink storage chamber 68 is not close-fitted to the bottom portion of the main body case 65.

A height of the upper cylindrical portion 71 formed on the lid 74 of the ink storage chamber 68 is made higher than a thickness of the lid 69 for the entire case by a preselected length. As a consequence, when the ink storage chamber 68 is stored/arranged within the empty chamber 67 and also the lid 69 is adhered onto the main body case 65 by using an adhesive agent or by way of ultrasonic melting method, a space may be formed between the upper surface of the ink storage chamber 68 and the lid 69, since the height of the upper cylindrical portion 71 is made larger than the thickness of the lid 69. In other words, the upper surface of the ink storage chamber 68 is arranged in such a manner that this upper surface is not close-fitted to the upper portion of the main body case 65 after being assembled.

That is, this ink cartridge 44 is arranged, while having a predetermined space formed between the outer wall of this ink cartridge 44 and the ink storage chamber 68. As a consequence, when an unfair user tries to refill the genuine ink by not using this inventive refilling hole portion 72, the following unfair ink-refilling preventing effect can be achieved. That is, as explained above, the space is formed between the outer wall of the ink cartridge 44 and the wall of the ink storage chamber 68. When such an unfair user pierces the wall of the ink cartridge 44 and then the wall of the ink storage chamber 68 so as to refill the ink, even if a first hole (not shown) formed in the outer wall of this ink cartridge 44 could be stopped by using, e.g., a seal (not shown), a second hole formed (not shown) in the wall of the ink storage chamber 68 cannot be stopped, because of the above-explained space. Precisely speaking, the first hole can be stopped, but the second hole cannot be stopped by using such a seal. As a result, even when the unfair user can succeed in refilling of the ink into the ink storage chamber 68 provided inside the ink cartridge 44, this refilled ink may be leaked out from the ink storage chamber 68 via the second hole into such a space. In other words, as a result, this ink cartridge 44 according to the embodiment is constructed in such a manner that the ink cannot be refilled unless such a genuine using the refilling hole portion 72 is utilized.

Then, as indicated in FIG. 5A, 3 sets of ink storage chambers 68 are stored into the empty chambers 67, respectively. As shown in FIG. 5B, the lid 69 covers the upper portions of these ink storage chambers 68 to be adhered thereon. Thereafter, the label 49 is attached to a position indicated by a broken line 81 of FIG. 5B so as to seal the refilling hole portions 72 formed in the three positions. Furthermore, the opening plane of the lower portion of the lower cylindrical portion 77 is sealed, so that the ink cartridge 44 can be finally made up, as represented in FIG. 1B, or FIG. 3A. This ink cartridge 44 is properly wrapped as a final product, and then this final ink cartridge is shipped from the factory to the market.

It should also be noted that the respective structural elements of the above-explained cartridge 44 may be jointed to each other by employing the above-explained adhesive agent, or ultrasonic melting method. In any case, while the joint portions are made in close-contact with each other and the space portion formed between the ink storage chamber 68 and the main body case 65 of the ink cartridge 44 is externally sealed, any fluid other than the ink, e.g., water may be filled into the space portion.

Alternatively, the ink may be refilled into the ink storage chamber 68 during manufacturing operation of this ink cartridge 44 before the lid 69 covers the ink storage chambers and then the main body case 65 is jointed to the refilling hole portion 72 of the ink storage chamber 68, namely, as illustrated in FIG. 4, before the ink storage chamber 68 is covered with another lid 74. In this alternative case, a final ink-cartridge product may be shipped under such a condition that the refilling hole portion 72 covered by the label 49 is not opened. Otherwise, at the manufacturing stage indicated by FIG. 5A, or FIG. 5B, the ink may be refilled into the ink storage chambers. In this alternative case, a final ink-cartridge product may be shipped under such a condition that the refilling hole portion 72 covered by the label 49 is opened.

STRUCTURES OF INK REFILLING MEMBERS

Figure 6:
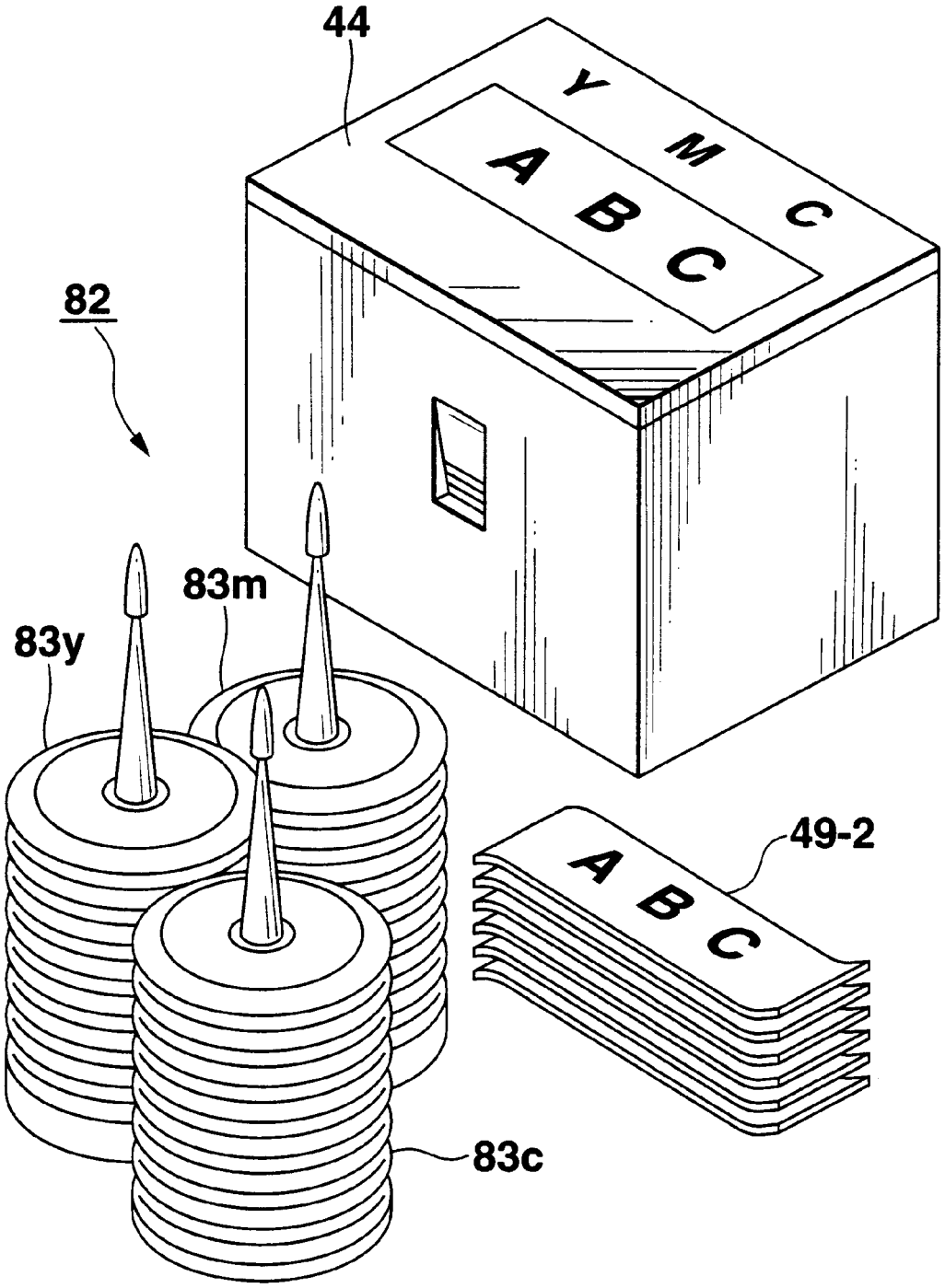
FIG. 6 is a perspective view for representing an ink refilling member according to an embodiment of the present invention.

In FIG. 6, there is shown an ink refilling member 82, according to an embodiment of the present invention, used to refill ink into the ink cartridge 44 with the above-explained structure when the ink stored in this ink cartridge 44 is depleted. As shown in this drawing, this ink refilling member 82 may be provided as one set by three ink refilling bottles 83, and a predetermined number of repapering labels 49-2 together with a first ink cartridge 44. These three ink refilling bottles 83 are arranged by a bottle 83*y* for storing thereinto yellow ink, a bottle 83*m* for storing thereinto magenta ink, and a bottle 83*c* for storing thereinto cyan ink. A total number of these repapering labels 49-2 corresponds to a total ink capacity of these refilling ink bottles. It should be noted that the above-explained labels are manufactured with adhesive agent and exfoliation paper.

Figure 7:
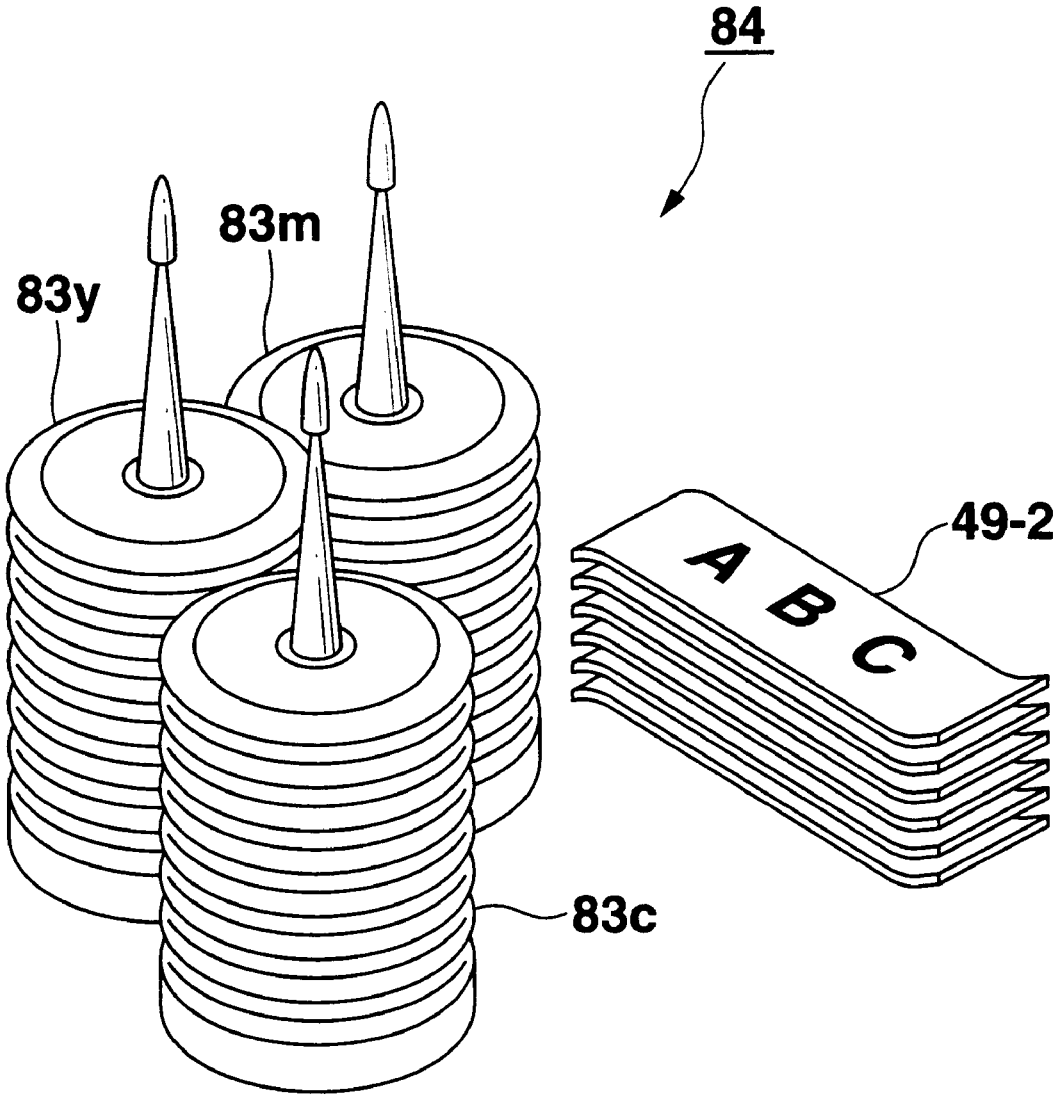
FIG. 7 is a perspective view for showing another ink refilling member according to another embodiment of the present invention.

FIG. 7 is a perspective view for indicating an ink refilling member according to another embodiment of the present invention. Generally speaking, there are many cases that a first ink cartridge 44 is initially mounted when an ink-jet printer is purchased. As a consequence, as this ink refilling member, as represented in FIG. 6, while this ink refilling member dose not contain the ink cartridge, only three ink refilling bottles 83, and a preselected number of repapering labels 49-2, which corresponds to the refilling ink capacities of these ink refilling bottles 83 may be used as one set.

Figure 8A:
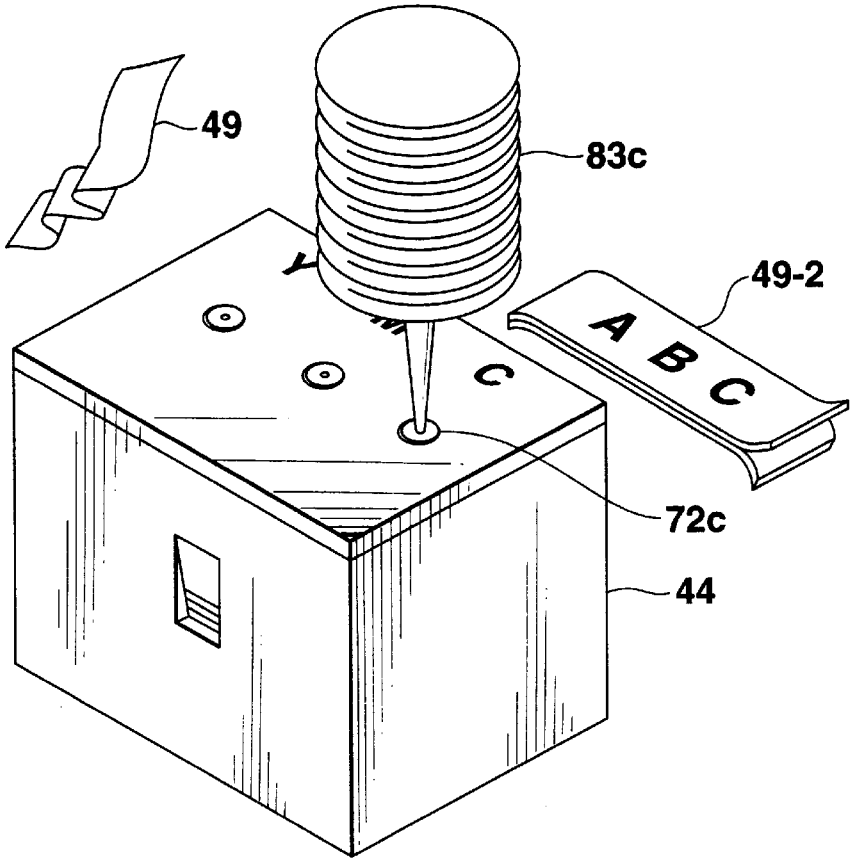
FIG. 8A and FIG. 8B are perspective view for explaining refilling operation of ink by using the ink refilling member of the embodiment.
Figure 8B:
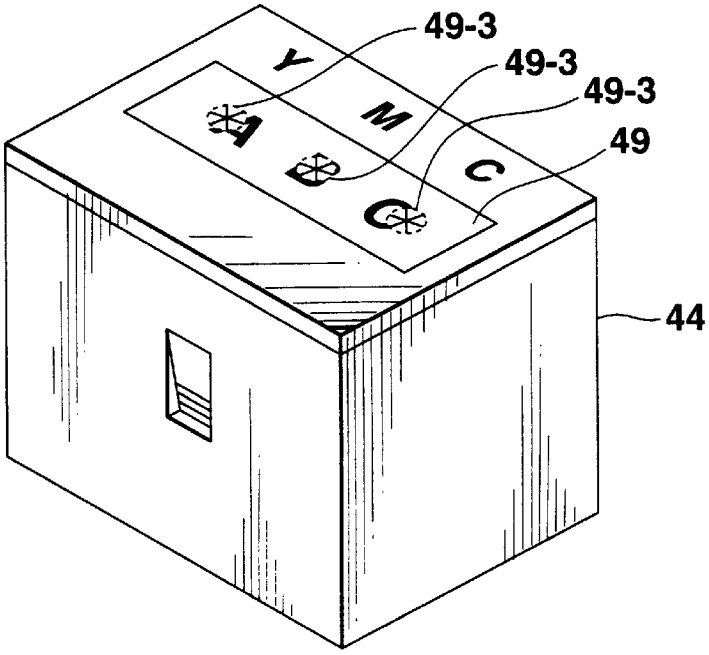

FIG. 8A and FIG. 8B are explanatory diagrams for explaining that ink is refilled by employing such an ink refilling member 82, or 84. As indicated in FIG. 8A, first, the label 49 adhered on the ink cartridge 44 is peeled, and the nozzle tip portion of the ink refilling bottle 83*c* is inserted into the hole of the refilling hole portion 72*c* of this ink cartridge 44, and then the ink is refilled into the relevant ink storage chamber in order that a preselected color of ink should be refilled.

When the ink is sufficiently refilled to the ink holding member 73 provided in the ink storage chamber 68, such a very small amount of this refilled ink is leaked from the opening portion, this leaked ink is swept by using properly-selected paper, cloth, and cotton so as to clean the portions adjacent to the opening portion. This ink refilling operation is similarly carried out as to the magenta ink and the yellow ink. After these three color ink has been refilled into the ink cartridge, exfoliation paper of a new label 49-2 is peeled, and then, this new label 49-2 is adhered onto the same place where the above-explained old label 49 was adhered. As a result, the respective holes of the refilling hole portions 72 formed in three positions may be sealed, and also the same condition as that of the new ink cartridge may be recovered. When this refilled ink cartridge 44 is mounted on the apparatus main body 30*a*, the information described on this label 49-2 is detected to be judged as a genuine ink cartridge. As a consequence, the printing operation by this refilled ink cartridge 44 can be carried out without any problem.

FIG. 8B represents such an ink-refilled condition of an ink cartridge that the ink is refilled through the refilling hole portion 72 by piercing the label 49 of the used ink cartridge 44 from the upper direction of this label 49 without peeling the label 49 of this used ink cartridge 44 (different from the previous embodiment a shown in FIG. 8A). In this case, as indicated in FIG. 8B, since the information (trademark character in this example) described on such a portion corresponding to the refilling hole portion 72 of the label 49 is broken, even when this ink cartridge is directly mounted on the apparatus main body 30*a* without any treatment, this ink cartridge cannot be judged as the genuine ink cartridge, so that no printing operation can be performed. In other words, this ink cartridge 44 cannot be directly used without any treatment.

This implies that refilling of not-genuine ink can be avoided. It should also be understood that even when the ink is refilled as explained in FIG. 8B, if either the genuine ink refilling member 82 or the genuine ink refilling member 84 is employed, then the new label 49-2 may be overlapped on this broken label 49. In this case, when such an ink cartridge 44 is mounted on the apparatus main body 30*a*, the information described on this new label 49-2 may be judged as the genuine ink cartridge, so that the printing operation by this ink cartridge can be carried out.

It should also be noted that in FIG. 8A, the peeled label 49 may be manufactured by employing such a thin sheet material having a flexible plasticity characteristic. That is, this thin sheet material may be easily deformed, may be readily waved, or may be easily broken when this label 49 is peeled. When this label 49 is manufactured in accordance with the above-described plasticity sheet material, even if not-genuine ink is refilled into the genuine ink cartridge 44 without using the genuine ink refilling member 82, or 84 and further the above-explained peeled label 49 is again attached on this genuine ink cartridge 44, there is no possibility that this refilled ink cartridge 44 is judged as a genuine product. Namely, this refilled ink cartridge 44 cannot be normally used, i.e., no printing operation.

However, there is a small possibility that some person may peel the label 49 without any damage, and thereafter may again attach this peeled label 49 to the genuine ink cartridge 44 by refilling such not-genuine ink thereinto. In this case, this not-genuine ink may be used. Also, in the case that the ink refilling member 82, or 84 is provided, if the newly attached label 49-2 is made greatly deformable, is made easily wavable, or is made readily broken, then this label 49-2 may be hardly handled before being attached, which requires very cumbersome treatments. However, to avoid such difficulties with respect to the user-friendly product, if this newly attached label 49-2 is made of a material which can be hardly deformed, then any one can easily again attach the peeled label, namely unfair use.

Figure 9A:
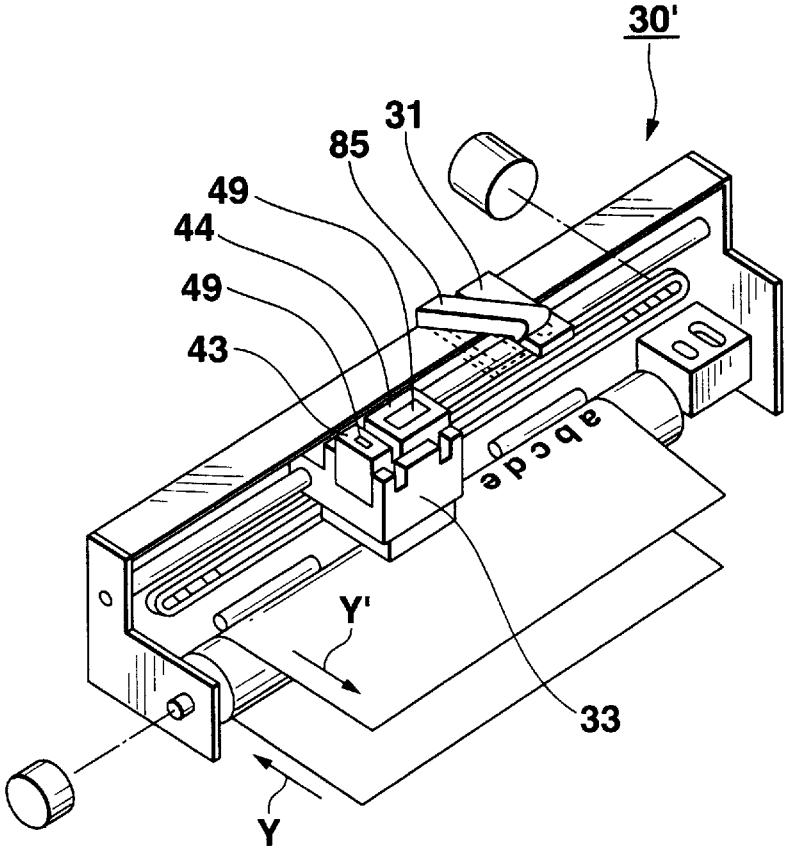
FIG. 9A is a perspective view for representing a construction of a major portion of an ink-jet printer, according to another embodiment of the present invention, which is used to further avoid an occurrence of improper operation.
Figure 9B:
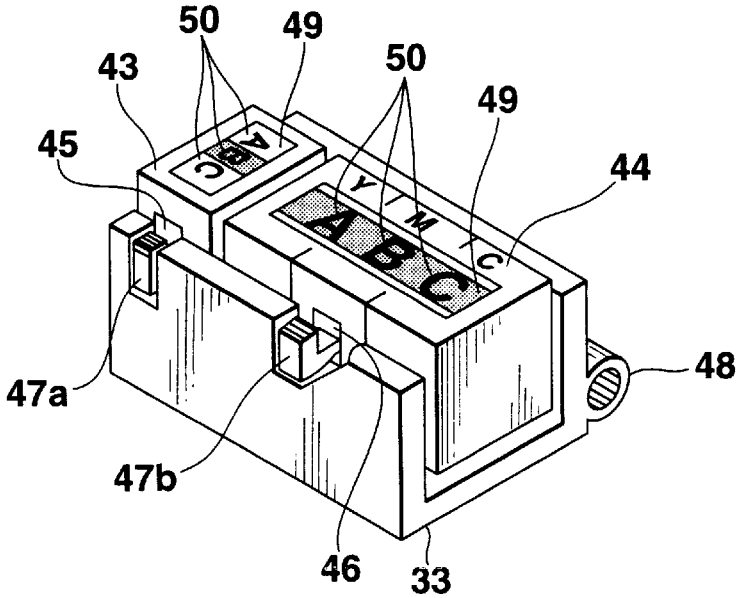
FIG. 9B is a perspective view for showing an enlarged major portion of the ink-jet printer shown in FIG. 9A used to explain such a condition that a label is written in such a manner that information described on this label constitutes improper information.

FIG. 9A is a perspective view for representing a construction of a major portion of an ink-jet printer, according to another embodiment of the present invention, which is used to further avoid the above-described occurrence of improper operation. FIG. 9B is a perspective view for showing an enlarged major portion of the ink-jet printer shown in FIG. 9A used to explain such a condition that a label is written in such a manner that information described on this label constitutes improper information. As indicated in FIG. 9A, in the ink-jet printer 30', a writing apparatus 85 is newly arranged. This writing apparatus 85 writes the information (for example, logogram "ABC") described on the label 49 as improper information with respect to an apparatus main body 30*a'*. It should be understood that since the structural elements of this ink-jet printer 30' other than this writing apparatus 85 and a control portion thereof are identical to those of the first-mentioned ink-jet printer 30 shown in FIG. 1, reference numerals to be given to the respective structural elements (except for structural elements required for explanation) are omitted. An arrangement of a control apparatus employed in this ink-jet printer 30' owns the following only different technical aspect from that of the first-mentioned ink-jet printer 30 of FIG. 1. That is, in this control apparatus of the ink-jet printer 30', the write drive control operation is merely carried out just before the MPU 54 notifies the ink depletion (namely, need of ink cartridge replacement) to the overall writing apparatus 85 indicated by two dots/dash line shown in FIG. 2. As a consequence, a detailed explanation of the printing control operation is omitted.

In FIG. 9A and FIG. 9B, in order to make the arrangement of this ink-jet printer 30' simpler, labels 49 used for both the black ink cartridge 43 and the color ink cartridge 44 are made of thermosensitive paper, and furthermore, the writing apparatus 85 is arranged by employing either a pivotable thermal head or a heat radiating member. In synchronism with the notification of the ink depletion, the writing apparatus 85 is pivoted downwardly as indicated by a broken line when the carriage 33 reaches the same position as this writing apparatus 85. Then, this writing apparatus 85 causes a preselected region on the label 49 to be colored in black (see FIG. 9B). As a consequence, the logogram character "ABC" of this label 49 cannot be read, so that the respective ink cartridges 43 and 44 having the black-colored labels 49 can be no longer recognized as the genuine ink cartridges.

When the writing apparatus rewrites the information described on the label 49 into the improper information, there is no need to change the substantially entire region of the label 49 (see color ink cartridge 44 of FIG. 9B) into the solid black region. Alternatively, only a partial region of the label for the black ink cartridge 43 may not be read. Furthermore, the solid black region may be replaced by a straight line. Also, the type of this writing apparatus 85 is not limited to the above-explained thermal type writing apparatus, but may be realized by, for instance, a stamp mechanism with using such a not-erasable ink to stamp the label 49 (in this alternative case, label 49 need not be thermosensitive label). Other various modifications may be realized. In the above-described embodiment mode, the trademark has been employed as the most preferable description 50 of the label 49. Alternatively, such a trademark may be replaced by other marks without departing from the technical scope and spirit of the present invention.

Figure 10:
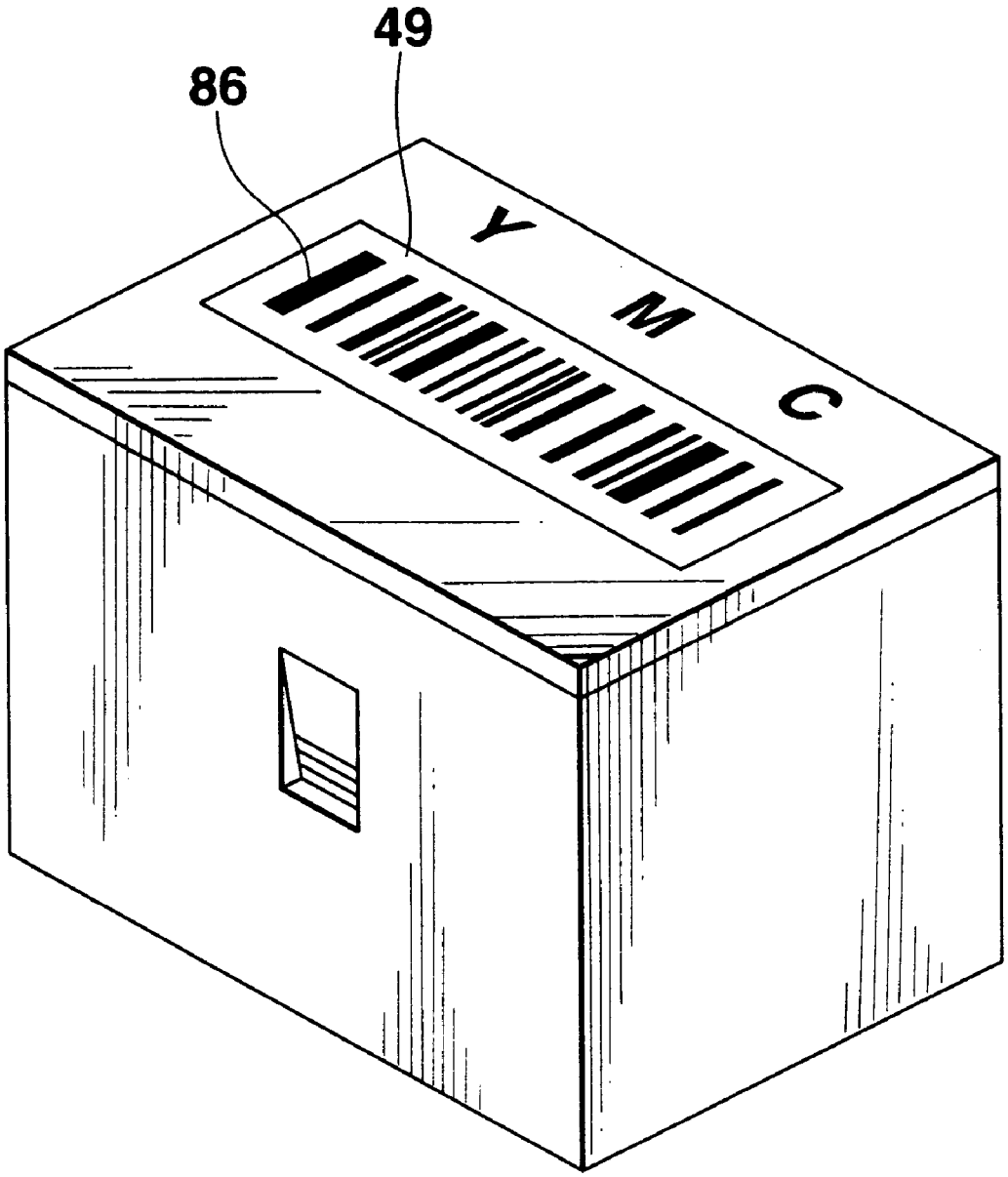
FIG. 10 is a perspective view for representing an ink cartridge according to another embodiment of the present invention, in which information described on a label thereof is indicated by a mark other than a trademark.

FIG. 10 illustrates an example of mark information described on a label, except for a trademark. That is, in this embodiment, the information 86 described on the label 49 is a bar code. This bar code describes such various information as a maker symbol, a relevant model name, a guarantee time limit, and a lot number. Similar to the above-explained trademark case, the maker symbol information may constitute such judgement information used to judge as to whether or not either an ink cartridge, or refilling ink corresponds to a genuine product supplied from a printer maker. The relevant model name information may constitute such judgement information used to judge as to whether or not either ink cartridge, or a refilling ink is adaptable to a relevant ink-jet printer in the case that ink having different ink characteristic is set with respect to a printer model. This may achieve more effective ink managements. Usually, since ink characteristics of this sort of ink will be changed while time has elapsed, guarantee time limits are set. When the guarantee time limit information is used in such a judgement, if this guarantee time limit largely exceeds a predetermine time limit, then this ink cartridge is judged as an improper ink cartridge, so that the printing operation by this ink cartridge is stopped. Alternatively, this fact may be notified to the user.

As previously explained, even when the above-described modification is employed, there is a practical merit. In this modification, since the such a bar code is employed, there is such an advantage. That is, the detecting apparatus 31 shown in FIG. 1A may be realized by a relatively simple structure, for example, a photosensor. Also, even if the above label 49 is replaced by a not-genuine label, the control unit provided in the apparatus main body can easily judge as to whether or not this checked label is a genuine label by identifying this lot number information with the genuine lot number information.

It should further be noted that although the large-sized trademark has been employed to seal the three refilling hole portions in the above-explained embodiment, various modifications may be realized if any refilling hole portion is firmly sealed by a label on which a specific pattern is described. As a consequence, for instance, in the example shown in FIG. 5B, another label may be conceived. That is, although a size of this alternative label is equal to the size of the label 49, a description thereof is smaller than the description 50 of the label 49, by which may seal at least one refilling hole.

While the present invention has been described in detail, the present invention can provide the following various advantages. That is, if the newly replaced ink cartridge is equal to a so-called "not-genuine" ink cartridge when the ink stored in the old ink cartridge is depleted, then the printing operation by this not-genuine ink cartridge (namely, newly replaced ink cartridge) cannot be carried out. As a result, it is possible to avoid an occurrence of unfair (not-genuine) printing operation, and malfunction of an ink-jet printer before an actual printing operation is carried out. Also when ink stored in a genuine ink cartridge is depleted, this ink cartridge is designed to be refilled by genuine ink. As a result, a disposable type ink cartridge is no longer required. Moreover, since this ink cartridge is designed by refilling only such genuine ink thereinto, the printing operation can be continuously carried out only by employing the genuine components and also the genuine materials. As a consequence, the high quality printing operation can be carried out for a long time period. In addition, since this ink cartridge is designed by refilling only such genuine ink thereinto, even when malfunction happens to occur, the malfunction cause can be quickly found out to repair the failure component. As a consequence, the high product reliability can be maintained for a long time period, and furthermore, the occurrence of malfunction can be immediately searched to thereby provide proper printing operations.

What is claimed is:

1. In an ink-jet recording apparatus in which an ink cartridge is equipped with a printing unit for mounting thereon a printing head; an ink storage chamber for storing thereinto ink; an ink refilling hole portion fluidly coupled with said ink storage chamber and enabling the refilling of ink into said ink storage chamber; and a label on which predetermined information is described, attached so as to seal said ink refilling hole portion; said ink cartridge is detachably mounted on said printing unit; and the ink supplied from said ink cartridge is jetted from said printing head so as to print out on paper, said ink-jet recording apparatus comprising:

detecting means for reading out said predetermined information described on said label;

judging means for judging whether or not said predetermined information read by said detecting means is information adapted to an own ink-jet recording apparatus;

print control means for determining whether or not a printing operation is carried out by employing said ink cartridge mounted thereon based upon the judgment performed by said judging means;

ink information notifying means issuing a notification of one of a need to replace said ink cartridge by a new ink cartridge and a need to refill ink in response to detection that an amount of ink stored in said ink storage chamber is reduced to a preselected ink amount, since the ink cartridge equipped with the label for describing the adapted information is used to jet the ink; and writing means for rewriting the adapted information of the label attached on said ink cartridge into non-adaptable information for said own ink-jet recording apparatus in conjunction with the notification issued from said ink information notifying means.

2. An ink-jet recording apparatus as claimed in claim 1 wherein:

said label includes a thermosensitive material, and said writing means includes a heat radiating member.

3. An ink-jet recording apparatus as claimed in claim 1 wherein:

said writing means is arranged by a stamp mechanism.

4. An ink cartridge detachably mounted on a printing unit of an ink-jet recording apparatus, comprising:

an ink storage chamber for storing thereinto ink;

an ink refilling hole portion fluidly coupled with said ink storage chamber and enabling the refilling of ink into said ink storage chamber; and a label attached onto said ink cartridge so as to seal said ink refilling hole portion, on which predetermined information is described, said predetermined information being read by detecting means, provided in said ink-jet recording apparatus, when said ink cartridge with said label is mounted on said ink-jet recording apparatus, whereby ink is jetted from a printing head mounted on said printing unit so as to print on paper, and the predetermined information being so described by writing means in said ink-jet on said label is non-adaptable to said ink-jet recording apparatus.

5. An ink cartridge as claimed in claim 4 wherein:

said ink cartridge is provided with a predetermined space defined between an outer wall of said ink cartridge and said ink storage chamber; and said predetermined space is capable of prohibiting that the ink is refilled into said ink storage chamber without using said ink refilling hole portion.

6. An ink-jet recording apparatus as claimed in claim 5, further comprising:

a repapering label in which said information to be read is described on one surface of said repapering label; an adhesive agent is provided on an other surface thereof; and said repapering label is formed via said adhesive agent with exfoliation paper in an integral form; whereby said repapering label is separated from said exfoliation paper and then is capable of sealing said ink refilling hole portion.

7. An ink-jet recording apparatus as claimed in claim 5 wherein:

said label includes a thermosensitive label.

8. An ink-jet recording apparatus as claimed in claim 5 wherein:

said information to be read is such information for indicating that the ink cartridge with said label is adapted to said ink-jet recording apparatus.

9. An ink-jet recording apparatus as claimed in claim 8 wherein:

said information to be read is a description of a trademark.

10. An ink-jet recording apparatus as claimed in claim 8 wherein:

said information to be read is a bar code.

11. An ink-jet recording apparatus as claimed in claim 4 wherein:

said information to be read is such information for indicating that the ink cartridge with said label is adapted to said ink-jet recording apparatus.

12. An ink-jet recording apparatus as claimed in claim 11 wherein:

said information to be read is a description of a trademark.

13. An ink-jet recording apparatus as claimed in claim 11 wherein:

said information to be read is a bar code.

14. An ink-jet recording apparatus as claimed in claim 4 wherein:

said label includes a thermosensitive label.

15. An ink-jet recording apparatus as claimed in claim 4, further comprising:

a repapering label in which said information to be read is described on one surface of said repapering label; an adhesive agent is provided on an other surface thereof;

and said repapering label is formed via said adhesive agent with exfoliation paper in an integral form; whereby said repapering label is separated from said exfoliation paper and then is capable of sealing said ink refilling hole portion.

16. An ink refilling member for refilling ink into an ink cartridge having an ink refilling hole portion which is communicated with an ink storage chamber and is capable of refilling the ink, said ink cartridge being detachably mounted on a printing unit of an ink-jet recording apparatus wherein the ink is jetted from a printing head mounted on the printing unit to thereby print out on paper, comprising:

an ink refilling vessel for storing thereinto ink which is refilled via said ink refilling hole portion into said ink storage chamber of the ink cartridge; and a repapering label in which predetermined information is described on one surface of said repapering label; an adhesive agent is provided on the other surface thereof; said repapering label is formed via said adhesive agent with exfoliation paper in an integral form; and said predetermined information is to be read by detecting means provided in said ink-jet recording apparatus when said ink cartridge with said label is mounted on said ink-jet recording apparatus, whereby said repapering label is separated from said exfoliation paper and then is capable of sealing said ink refilling hole portion.

17. An ink refilling member as claimed in claim 16 wherein:

said repapering label is a thermosensitive label.

18. An ink refilling member as claimed in claim 16 wherein:

said information to be read is such information for indicating that the ink cartridge with said label is adapted to said ink-jet recording apparatus.

19. An ink refilling member as claimed in claim 18 wherein:

said information to be read is a description of a trademark.

20. An ink refilling member as claimed in claim 18 wherein:

said information to be read is a bar code.

* * * * *